US009028103B2

(12) United States Patent
Lee

(10) Patent No.: US 9,028,103 B2
(45) Date of Patent: May 12, 2015

(54) NON-ISOLATING CIRCUIT ASSEMBLY AND LAMP USING THE SAME

(75) Inventor: Hsuan-Hsien Lee, New Taipei (TW)

(73) Assignee: Edison Opto Corporation, New Taipei (TW)

( * ) Notice: Subject to any disclaimer, the term of this patent is extended or adjusted under 35 U.S.C. 154(b) by 422 days.

(21) Appl. No.: 13/472,372

(22) Filed: May 15, 2012

(65) Prior Publication Data

US 2013/0107538 A1 May 2, 2013

(30) Foreign Application Priority Data

Oct. 28, 2011 (TW) ..... 100139401 A

(51) Int. Cl.
*F21V 29/00* (2006.01)
*F21K 99/00* (2010.01)

(52) U.S. Cl.
CPC . *F21K 9/135* (2013.01); *F21K 9/00* (2013.01); *F21V 29/70* (2015.01); *F21V 29/89* (2015.01); *F21V 29/22* (2013.01); *F21V 29/15* (2015.01)

(58) Field of Classification Search
CPC ..... F21K 9/00; F21K 9/135; F21V 29/15; F21V 29/22; F21V 29/70; F21V 29/89
USPC ..... 362/294, 311.02, 373
See application file for complete search history.

(56) References Cited

U.S. PATENT DOCUMENTS

2005/0110649 A1 5/2005 Fredericks et al.
2011/0210657 A1 9/2011 Paik
2013/0258669 A1* 10/2013 Qin ..... 362/249.02

FOREIGN PATENT DOCUMENTS

CN 101532654 A 9/2009
CN 201355473 Y 12/2009
CN 102109116 A 6/2011
JP 2011181248 A 9/2011
TW 200801395 1/2008
TW M372430 1/2010
TW M395121 12/2010
TW M402996 5/2011

OTHER PUBLICATIONS

Office Action for corresponding Chinese Patent Application No. 201110353976.3, 6 pages, (Mar. 14, 2014).
Office Action for corresponding Taiwanese Patent Application No. 10320082170, 6 pages, (Jan. 21, 2014).

* cited by examiner

*Primary Examiner* — Stephen F Husar
(74) *Attorney, Agent, or Firm* — Blakely, Sokoloff, Taylor & Zafman LLP

(57) ABSTRACT

A non-isolating circuit assembly includes a heat sink, a circular supporting member, a thermal insulation pad, and a light emitter. The heat sink has an inwardly-shrank platform. The circular supporting member is disposed around the outer edge of the inwardly-shrank platform. The thermal insulation pad is disposed on the inwardly-shrank platform and the circular supporting member. The area of the thermal insulation pad is larger than that of the inwardly-shrank platform, and the circular supporting member supports the outer edge of the thermal insulation pad. The light emitter is disposed on the thermal insulation pad.

15 Claims, 2 Drawing Sheets

NON-ISOLATING CIRCUIT ASSEMBLY AND LAMP USING THE SAME

RELATED APPLICATIONS

This application claims priority to Taiwan Application Serial Number 100139401, filed Oct. 28, 2011, which is herein incorporated by reference.

BACKGROUND

1. Field of Invention

The present invention relates to a non-isolating circuit assembly and a lamp using the same, and more particularly, to a non-isolating circuit assembly and a lamp using the same, in which the insulation distance of internal circuits is increased through use of the non-insolating circuit assembly.

2. Description of Related Art

There is a significant amount of energy consumption associated with conventional illumination techniques. As a result, the development of techniques to realize lighting energy savings is one of the most important areas of new energy technology research. High-power and high-brightness light-emitting diodes, which are semiconductor light sources, are increasingly being used. Light-emitting diodes have many advantages including high luminous efficiency, low energy use, long lifetime, being environmentally friendly (since no mercury is used), fast starting, good directionality, etc., and as a result, have the potential to fully replace conventional lighting sources.

In order to bring the foregoing advantages into play, the junction temperature of light-emitting diodes must be decreased as much as possible with the assistance of highly efficient heat-dissipating mechanisms. Failure to sufficiently decrease the junction temperature will result in the brightness and lifetime of light-emitting diode lamps to be greatly reduced. Moreover, not only is the energy-saving effect of the light-emitting diode lamps reduced, but also, the reliability of the light-emitting diode lamps is directly impacted when the junction temperature is not sufficiently reduced. In some instances, serious light attenuation performance occurs and/or the light-emitting diode lamps may even fail.

Due to the small size of heat-dissipating devices in some existing lamps, only non-isolating fixed current driving circuits with a small size can be used, and it is not possible to use isolating circuits (e.g., a converter). If light-emitting diodes are used as light sources in a lamp applying a non-isolating fixed current driving circuit, the non-isolating fixed current driving circuit is able to convert the inputted AC power into DC power to drive the light-emitting diodes.

However, the non-isolating fixed current driving circuit does not buck and isolate the inputted AC power and the outputted DC power. If dangerous situations are encountered, such as exposure to lightning strikes (a non-human factor) or high voltage caused by an unstable power system (a human factor), the lamp using the non-isolating fixed current driving circuit will not be able to meet safety regulations such as CE (European Conformity), CUL (Product Safety Listed, Canada), etc. (i.e., the surge voltage that circuits and housings can withstand must be at least 4 kv, and current must be smaller than 10 mA).

That is, although plastic or other insulation materials can be used around the edges of a non-isolating fixed current driving circuit for isolation purposes, a circuit outputting terminal and a heat-conducting substrate make the non-isolating fixed current driving circuit a dangerous electrified body. Therefore, developing an insulation design capable of conducting heat and withstanding voltage for non-isolating fixed current driving circuits is an area that the industry must urgently explore and research.

SUMMARY

The invention provides an improved non-isolating circuit assembly. In the non-isolating circuit assembly of the invention, an inwardly-reduced platform is disposed at the top of a heat sink, a circular supporting member is disposed around the inwardly-reduced platform, and a thermal insulation pad having an area larger than that of the inwardly-reduced platform is disposed on the inwardly-reduced platform and the circular supporting member. Through such a configuration, the insulation distance between a substrate that is disposed on the thermal insulation pad and the heat sink and measured by passing around the thermal insulation pad is increased. Therefore, the invention can achieve the purpose of increasing insulation distance without enlarging the size of the thermal insulation pad and still can achieve the effect of withstanding voltage. As a result, the invention may be used in small heat-dissipating structures. Moreover, the invention can use a thin thermal insulation pad and it is not necessary to employ a thick film forming method to increase the insulation distance, so that the thermal resistance between the substrate and the heat sink can be reduced and the ability to conduct heat and dissipate heat can be significantly improved. Furthermore, the invention allows of the continued use of the conventional aluminum heat sink for conducting electricity and heat. Compared with thermal plastic, the conventional aluminum heat sink has a higher thermal conduction and better performance of withstanding voltage.

According to an embodiment of the invention, a non-isolating circuit assembly includes a heat sink, a circular supporting member, a thermal insulation pad, and a light emitter. The heat sink has an inwardly-reduced platform. The circular supporting member is disposed around the outer edge of the inwardly-reduced platform. The thermal insulation pad is disposed on the inwardly-reduced platform and the circular supporting member. The area of the thermal insulation pad is larger than that of the inwardly-reduced platform, and the circular supporting member supports the outer edge of the thermal insulation pad. The light emitter is disposed on the thermal insulation pad.

In an embodiment of the invention, the light emitter includes a substrate and a light source. The substrate is disposed on the thermal insulation pad. The light source is disposed on the substrate and thermally connected to the heat sink via the substrate and the thermal insulation pad.

In an embodiment of the invention, the material of the substrate includes aluminum.

In an embodiment of the invention, the contour of the inner edge of the circular supporting member and that of the outer edge of the inwardly-reduced platform are complementary, and the inner edge of the circular supporting member and the outer edge of the inwardly-reduced platform are tightly fit.

In an embodiment of the invention, the thermal insulation pad is a thermal silicone pad.

In an embodiment of the invention, the material of the circular supporting member includes plastic.

The invention further provides a lamp.

According to an embodiment of the invention, a lamp includes a heat sink, a circular supporting member, a thermal insulation pad, a light emitter, and a lens structure. The heat sink has an inwardly-reduced platform. The circular supporting member is disposed around the outer edge of the inwardly-reduced platform and includes a through hole. The thermal insulation pad is disposed on the inwardly-reduced platform and the circular supporting member. The area of the thermal insulation pad is larger than that of the inwardly-reduced platform, and the circular supporting member supports the outer edge of the thermal insulation pad. The light emitter is disposed on the thermal insulation pad. The lens structure is disposed on the light emitter and includes a hub. The through hole is able to accommodate the hub.

In an embodiment of the invention, the lamp further includes a fastening member and the hub is hollow. The heat sink includes a fastening hole, and the fastening member extends through the hub and is engaged with the fastening hole to thereby fix the lens structure to the heat sink.

In an embodiment of the invention, the edge of the thermal insulation pad is engaged with the hub.

In an embodiment of the invention, the edge of the substrate is engaged with the hub.

In an embodiment of the invention, the lens structure further includes a lens portion and a fixing portion. The lens portion is located on the light emitter. The fixing portion is formed around the periphery of the lens portion. The hub is located at the bottom of the fixing portion, and the circular supporting member supports the periphery of the fixing portion. The periphery of the light emitter and that of the thermal insulation pad are clamped between the fixing portion and the circular supporting member.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
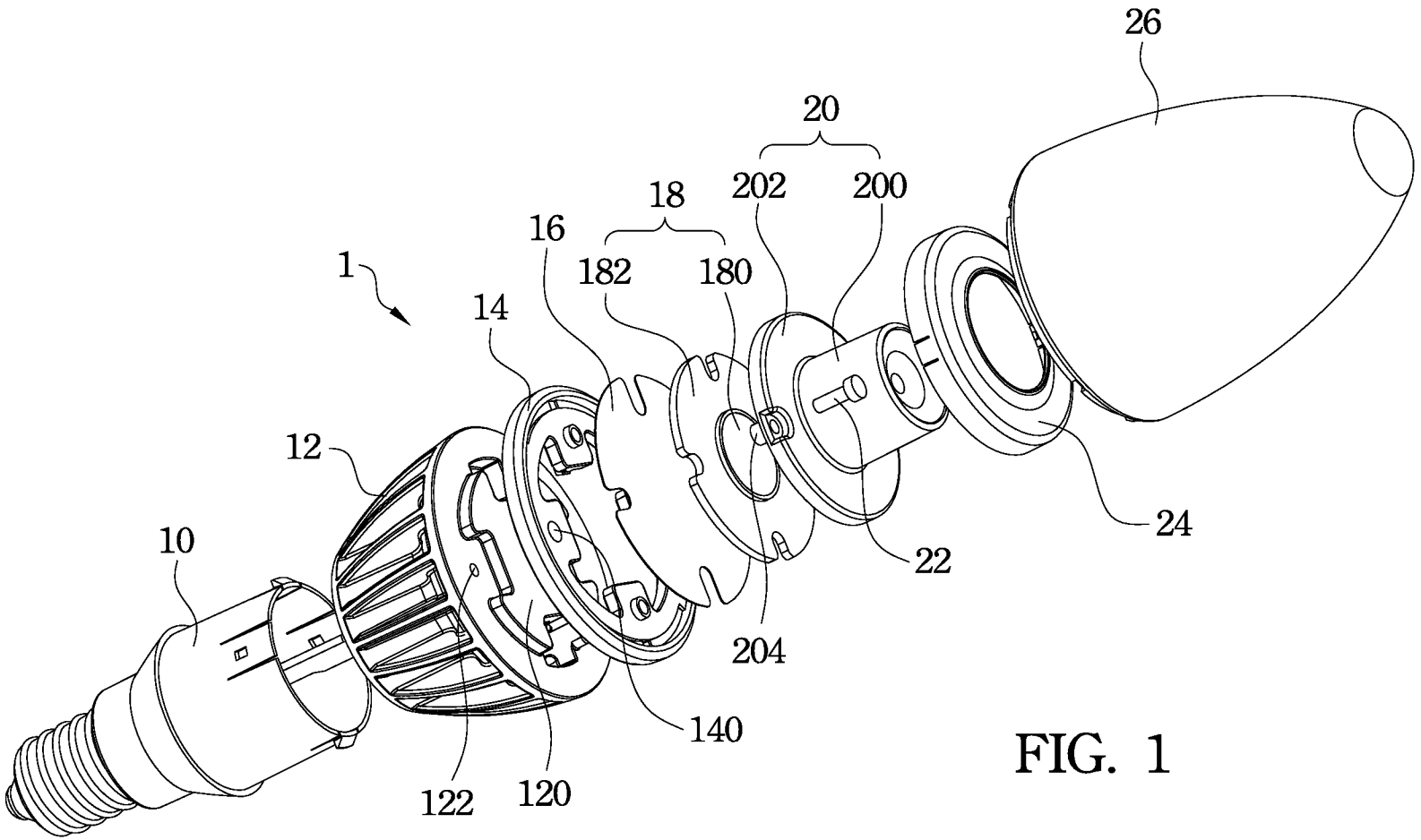
FIG. 1 is an exploded view of a lamp according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

An improved lamp is provided. Specifically, in the lamp of the invention, an inwardly-reduced platform is disposed at the top of a heat sink, a circular supporting member is disposed around the inwardly-reduced platform, and a thermal insulation pad having an area larger than that of the inwardly-reduced platform is disposed on the inwardly-reduced platform and the circular supporting member. Through such a configuration, the insulation distance between a substrate that is disposed on the thermal insulation pad and the heat sink and measured by passing around the thermal insulation pad is increased. Therefore, the invention can achieve the purpose of increasing insulation distance without enlarging the size of the thermal insulation pad and still can achieve the effect of withstanding voltage, thereby allowing the invention to be applied in small heat-dissipating structures. Moreover, the invention can use a thin thermal insulation pad and it is not necessary to employ a thick film forming method to increase the insulation distance, so that the thermal resistance between the substrate and the heat sink can be reduced and the capability of conducting heat and dissipating heat can be significantly improved. Furthermore, the invention can continue to use a conventional aluminum heat sink for conducting electricity and heat. Compared with thermal plastic, the conventional aluminum heat sink has higher thermal conduction and better performance of withstanding voltage.

Figure 2:
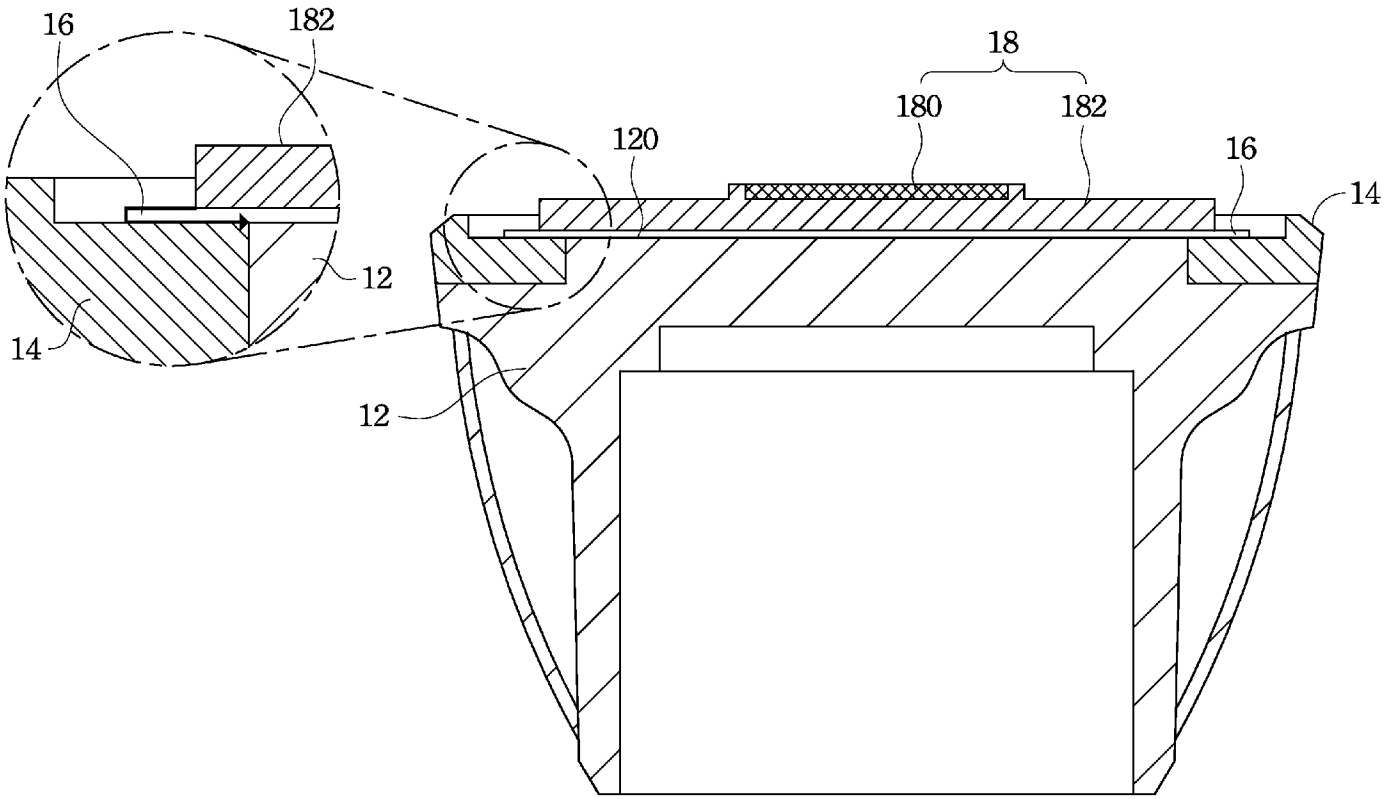
FIG. 2 is a sectional view of the assembled non-isolating circuit assembly in FIG. 1.

FIG. 1 is an exploded view of a lamp 1 according to an embodiment of the invention. FIG. 2 is a sectional view of the assembled non-isolating circuit assembly in FIG. 1.

As shown in FIG. 1 and FIG. 2, the lamp 1 according to the embodiment of the invention includes a base 10, a non-isolating circuit assembly, a lens structure 20, a lens cover 24, and a lamp cover 26. The non-isolating circuit assembly of the lamp 1 includes a heat sink 12, a circular supporting member 14, a thermal insulation pad 16, and a light emitter 18. The components disposed in the lamp 1 of the embodiment will be described in detail below.

Circuits (not shown) are disposed in the base 10 of the lamp 1. The base 10 of the lamp 1 can be engaged to the heat sink 12. The heat sink 12 of the non-isolating circuit assembly has a number of hollow portions and fin-like structures for increasing surface area directly contacting air, so as to improve the heat-dissipating performance thereof. The top of the heat sink 12 of the non-isolating circuit assembly has an inwardly-reduced platform 120 (i.e., the inwardly-reduced platform 120 is a raised platform formed on an upper surface of the heat sink 12). The width of the inwardly-reduced platform 120 is substantially smaller than the maximum width of the heat sink 12. That is, a maximum width of the inwardly-reduced platform 120 along a direction perpendicular to a long-axis direction of the lamp 1 (i.e., the vertical direction in FIG. 2) is substantially smaller than a maximum width of the heat sink 12 along the same direction.

The circular supporting member 14 of the non-isolating circuit assembly is disposed around the outer edge of the inwardly-reduced platform 120 of the heat sink 12. In the embodiment of the invention, in order to prevent the circular supporting member 14 from rotating relative to the inwardly-reduced platform 120 of the heat sink 12, the contour of the inner edge of the circular supporting member 14 and that of the outer edge of the inwardly-reduced platform 120 are complementary, and the inner edge of the circular supporting member 14 and the outer edge of the inwardly-reduced platform 120 are tightly fit to each other. Such a configuration also allows of a large heat conducting area and an effective insulation distance to be obtained.

The thermal insulation pad 16 of the non-isolating circuit assembly is disposed on the inwardly-reduced platform 120 of the heat sink 12 and the circular supporting member 14. The area of the thermal insulation pad 16 is larger than that of the inwardly-reduced platform 120 of the heat sink 12. Therefore, the outer edge of the thermal insulation pad 16 extends outwardly past the inwardly-reduced platform 120 of the heat sink 12 and is supported by the circular supporting member 14.

The light emitter 18 of the non-isolating circuit assembly is disposed on the thermal insulation pad 16. The lens structure 20 of the lamp 1 is disposed on the light emitter 18 and is optically coupled to the light emitter 18. The lens cover 24 of the lamp 1 is engaged to the periphery of the lens structure 20, so as to protect the lens structure 20. The lamp cover 26 of the lamp 1 is engaged to the circular supporting member 14 in such a manner that the thermal insulation pad 16, the light emitter 18, the lens structure 20, and the lens cover 24 can be accommodated between the lamp cover 26 and the circular supporting member 14.

The light emitter 18 of the non-isolating circuit assembly includes a substrate 182 and a light source 180. The substrate 182 of the light emitter 18 is disposed on the thermal insulation pad 16. The light source 180 of the light emitter 18 is disposed on the substrate 182 and is thermally connected to the heat sink 12 via the substrate 182 and the thermal insulation pad 16. In the embodiment of the invention, in order to obtain high efficiency of heat conduction, the material of the substrate 182 of the light emitter 18 includes aluminum, and the substrate material of the thermal insulation pad 16 is silicon (e.g., the thermal insulation pad 16 can be a thermal silicone pad), but the invention is not limited in this regard. In the embodiment, the light source 180 of the light emitter 18 is a light-emitting diode or an organic light-emitting diode, but the invention is not limited in this regard.

It can be seen that the invention can effectively increase the insulation distance between the substrate 182 of the light emitter 18 and the heat sink 12 (i.e., the distance from the edge of the substrate 182 of the light emitter 18, passing around the thermal insulation pad 16, and reaching the heat sink 12, as indicated by the arrow in FIG. 2) by designing the inwardly-reduced platform 120 with a smaller area under the thermal insulation pad 16 and by supporting the edge of the thermal insulation pad 16 with the circular supporting member 14. As a result, the lamp 1 of the invention with insulation designation of conducting heat and withstanding voltage can meet safety regulations such as CE, CUL, etc. even when dangerous situations such as exposure to lightning strikes (a non-human factor) or high voltage caused by an unstable power system (human factor) are encountered. In the embodiment of the invention, in order to prevent a conductive pathway from being formed between the light emitter 18 and the heat sink 12, the material of the circular supporting member 14 of the non-isolating circuit assembly includes plastic, but the invention is not limited in this regard.

A stereoscopic thermal silicone pad in the prior art must be manufactured by a thick film forming method, and the stereoscopic thermal silicone pad has a significant thickness (about 1 mm). Compared with the stereoscopic thermal silicone pad, the thermal insulation pad 16 can be formed by a stamp forming method, so the thickness of the thermal insulation pad 16 can be 0.2~0.6 mm (preferably be 0.3~0.5 mm). Therefore, the thermal insulation pad 16 of the invention has a reduced thermal resistance and can easily conduct heat.

Moreover, the thickness of a conventional thermal silicone pad that uses thermal plastic (i.e., thermal grease) to form the thermal silicone pad can be thinner than that of the thermal insulation pad 16 of the invention. However, the thickness of the thermal plastic for use as the conventional thermal silicone pad is non-uniform because the thermal plastic is in the form of paste when applied. In particular, when a light emitter is placed on the conventional thermal silicone pad, the thermal grease used to form the thermal silicon pad will be squeezed and displaced to the periphery of the light emitter. Hence, the thickness of the thermal grease under the light emitter may be thinned, and even it results in voids (and may be even removed completely in places) and thus results in the lamp not being able to satisfy voltage withstand requirements.

In summary, not only is the heat conducting capability of the thermal insulation pad 16 with a preferred thickness of the invention better than that of the foregoing prior art, but also the ability to withstand voltage can be realized.

As shown in FIG. 1, the lens structure 20 of the lamp 1 includes at least one hub 204. The circular supporting member 14 of the non-isolating circuit assembly includes a through hole 140. The through hole 140 of the circular supporting member 14 is able to accommodate the hub 204 of the lens structure 20. In other words, the diameter of the through hole 140 of the circular supporting member 14 is larger than the diameter of the hub 204 of the lens structure 20. Therefore, the hub 204 of the lens structure 20 can pass through the through hole 140 of the circular supporting member 14.

Moreover, the hub 204 of the lens structure 20 is hollow. The heat sink 12 further includes at least one fastening hole 122. The lens structure 20 is fixed to the heat sink 12 by passing a fastening member 22 (e.g., a screw) through the hub 204 and engaging the same to the fastening hole 122. If the lens structure 20 is made of an insulation material (e.g., a polymer material), the fastening member 22 that is engaged with the fastening hole 122 of the heat sink 12 after passing through the hub 204 of the lens structure 20 can be insulated from the substrate 182 of the light emitter 18 by the hub 204, so as to prevent the fastening member 22 from forming as a conductive pathway between the light emitter 18 and the heat sink 12.

Furthermore, the lens structure 20 of the lamp 1 further includes a lens portion 200 and a fixing portion 202. The lens portion 200 of the lens structure 20 is located on the light source 180 of the light emitter 18. The fixing portion 202 of the lens structure 20 is formed around the periphery of the lens portion 200. The hub 204 of the lens structure 20 is located at the bottom of the fixing portion 202. The circular supporting member 14 can support the periphery of the fixing portion 202. The periphery of the light emitter 18 and that of the thermal insulation pad 16 are clamped between the fixing portion 202 of the lens structure 20 and the circular supporting member 14.

As shown in FIG. 1, in order to prevent the light emitter 18 or the thermal insulation pad 16 between the lens structure 20 and the circular supporting member 14 from unstably sliding or rotating, the edge of the thermal insulation pad 16 can be designed to be engaged with the hub 204 of the lens structure 20, and/or the edge of the substrate 182 of the light emitter 18 can be similarly designed to be engaged with the hub 204 of the lens structure 20. Furthermore, the light emitter 18 and/or the thermal insulation pad 16 between the lens structure 20 and the circular supporting member 14 can also be prevented from unstably sliding or rotating by designing engaging structures on the circular supporting member 14 that can be engaged with the edge of the thermal insulation pad 16 and/or the edge of the substrate 182 of the light emitter 18.

The non-isolating circuit assembly of the invention is shown in an application to the omnidirectional lamp shown in FIG. 1, but the invention is not limited in this regard. The non-isolating circuit assembly of the invention can be applied to any kinds of omnidirectional lamp, decorative lamp, or directional lamp.

According to the foregoing recitations of the embodiments of the invention, it can be seen that in the non-isolating circuit assembly and the lamp of the invention, an inwardly-reduced platform is disposed at the top of a heat sink, a circular supporting member is disposed around the inwardly-reduced platform, and a thermal insulation pad having an area larger than that of the inwardly-reduced platform is disposed on the inwardly-reduced platform and the circular supporting member. Through such a configuration, the insulation distance between a substrate that is disposed on the thermal insulation pad and the heat sink and measured by passing around the thermal insulation pad is increased. Therefore, the invention can achieve the purpose of increasing insulation distance without enlarging the size of the thermal insulation pad and still can achieve the effect of withstanding voltage, thereby allowing the invention to be applied in small heat-dissipating structures. Moreover, the invention can use a thin thermal insulation pad and it is not necessary to employ a thick film forming method to increase the insulation distance, so that the thermal resistance between the substrate and the heat sink can be reduced and the capability of conducting heat and dissipating heat can be significantly improved. Furthermore, the invention can continue to use a conventional aluminum heat sink for conducting electricity and heat. Compared with thermal plastic, the conventional aluminum heat sink has higher thermal conduction and better performance of withstanding voltage.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A non-isolating circuit assembly comprising:

a heat sink having an inwardly-reduced platform;

a circular supporting member disposed around the outer edge of the inwardly-reduced platform, wherein the material of the circular supporting member comprises plastic;

a thermal insulation pad disposed on the inwardly-reduced platform and the circular supporting member, wherein the area of the thermal insulation pad is larger than the area of the inwardly-reduced platform, and the circular supporting member supports the outer edge of thermal insulation pad; and a light emitter disposed on the thermal insulation pad.

2. The non-isolating circuit assembly of claim 1, wherein the light emitter comprises: a substrate disposed on the thermal insulation pad; and a light source disposed on the substrate and thermally connected to the heat sink via the substrate and the thermal insulation pad.

3. The non-isolating circuit assembly of claim 2, wherein the material of the substrate comprises aluminum.

4. The non-isolating circuit assembly of claim 1, wherein the contour of the inner edge of the circular supporting member and the contour of the outer edge of the inwardly-reduced platform are complementary, and the inner edge of the circular supporting member and the outer edge of the inwardly-reduced platform are tightly fit.

5. The non-isolating circuit assembly of claim 1, wherein the thermal insulation pad is a thermal silicone pad.

6. A lamp comprising:

a heat sink having an inwardly-reduced platform;

a circular supporting member disposed around the outer edge of the inwardly-reduced platform, the circular supporting member comprising a through hole;

a thermal insulation pad disposed on the inwardly-reduced platform and the circular supporting member, wherein the area of the thermal insulation pad is larger than the area of the inwardly-reduced platform, and the circular supporting member supports the outer edge of the thermal insulation pad;

a light emitter disposed on the thermal insulation pad; and a lens structure disposed on the light emitter and comprising a hub, wherein the through hole is able to accommodate the hub.

7. The lamp of claim 6, wherein the light emitter comprises:

a substrate disposed on the thermal insulation pad; and a light source disposed on the substrate and thermally connected to the heat sink via the substrate and the thermal insulation pad.

8. The lamp of claim 7, wherein the edge of the substrate is engaged with the hub.

9. The lamp of claim 7, wherein the material of the substrate comprises aluminum.

10. The lamp of claim 6, further comprising a fastening member, wherein the hub is hollow, the heat sink further comprises a fastening hole, and the fastening member extends through the hub and is engaged with the fastening hole to thereby fix the lens structure to the heat sink.

11. The lamp of claim 6, wherein the edge of the thermal insulation pad is engaged with the hub.

12. The lamp of claim 6, wherein the lens structure further comprises:

a lens portion located on the light emitter; and a fixing portion formed around the periphery of the lens portion, the hub being located at the bottom of the fixing portion, and the circular supporting member supporting the periphery of the fixing portion, wherein the periphery of the light emitter and the periphery of the thermal insulation pad are clamped between the fixing portion and the circular supporting member.

13. The lamp of claim 6, wherein the contour of the inner edge of the circular supporting member and the contour of the outer edge of the inwardly-reduced platform are complementary, and the inner edge of the circular supporting member and the outer edge of the inwardly-reduced platform are tightly fit.

14. The lamp of claim 6, wherein the thermal insulation pad is a thermal silicone pad.

15. The lamp of claim 6, wherein the material of the circular supporting member comprises plastic.

* * * * *